US006408736B1

(12) United States Patent
Holt et al.

(10) Patent No.: US 6,408,736 B1
(45) Date of Patent: Jun. 25, 2002

(54) SYNCHRONIZING CYLINDER ASSEMBLY WITH EQUAL DISPLACEMENT HYDRAULIC CYLINDER

(75) Inventors: Douglas J. Holt, Livonia; Robert C. Adams, Jr., Romeo, both of MI (US)

(73) Assignee: Welker Bearing Company, Troy, MI (US)

( * ) Notice: Subject to any disclaimer, the term of this patent is extended or adjusted under 35 U.S.C. 154(b) by 0 days.

(21) Appl. No.: 09/615,428

(22) Filed: Jul. 13, 2000

Related U.S. Application Data

(60) Provisional application No. 60/143,423, filed on Jul. 13, 1999.

(51) Int. Cl.[7] ..... F01B 25/04
(52) U.S. Cl. ..... 91/171
(58) Field of Search ..... 91/171, 61, 108; 60/581; 92/110

(56) References Cited

U.S. PATENT DOCUMENTS

| | | | | | |
|---|---|---|---|---|---|
| 2,462,580 | A | * | 2/1949 | Watson | 91/365 |
| 3,949,650 | A | * | 4/1976 | Blatt et al. | 92/108 |
| 4,192,222 | A | | 3/1980 | Dits | |
| 4,343,226 | A | * | 8/1982 | Ribeiro de Almeida | 91/171 |
| 4,409,884 | A | * | 10/1983 | Boehringer | 91/171 |
| 4,543,517 | A | | 9/1985 | Poppelreiter, II | 318/632 |
| 4,738,101 | A | | 4/1988 | Kubik | 60/413 |
| 4,748,894 | A | * | 6/1988 | Foster | 91/520 |
| 4,750,408 | A | | 6/1988 | Stoll | 92/51 |
| 4,751,818 | A | | 6/1988 | Kubik | 60/444 |
| 4,833,971 | A | | 5/1989 | Kubik | 91/29 |
| 4,955,282 | A | | 9/1990 | Ranson | 91/436 |
| 5,048,292 | A | | 9/1991 | Kubik | 60/413 |
| 5,099,749 | A | * | 3/1992 | Darish | 92/108 |
| 5,120,022 | A | | 6/1992 | Kubik | 254/124 |
| 5,247,872 | A | | 9/1993 | Hoshi | 92/52 |
| 5,341,725 | A | | 8/1994 | Dick | 92/66 |
| 5,520,443 | A | | 5/1996 | Zanzig | |
| 5,522,212 | A | | 6/1996 | Kubik | 60/414 |
| 5,609,091 | A | | 3/1997 | Stoll | 92/110 |
| 5,778,669 | A | | 7/1998 | Kubik | 60/413 |
| 5,865,089 | A | | 2/1999 | Langer et al. | 92/110 |

FOREIGN PATENT DOCUMENTS

| | | | | | |
|---|---|---|---|---|---|
| GB | 2 028 432 | A | * | 3/1980 | 91/171 |

* cited by examiner

*Primary Examiner*—Edward K. Look
*Assistant Examiner*—Igor Kershteyn
(74) *Attorney, Agent, or Firm*—Young & Basile, P.C.

(57) ABSTRACT

A closed circuit synchronizing cylinder assembly for synchronously moving at least two external devices such that the devices move at the same rate and maintain essentially the same level within a small deviation. The synchronizing cylinder assembly has a cylinder with a movable piston and rod for each external device. The piston divides the interior of the cylinder into a rod outer diameter chamber, a rod inner diameter chamber and a third chamber. The rod outer diameter chamber and rod inner diameter chamber have equal areas and hydraulic fluid therein and third member is open to atmosphere. The hydraulic fluid in the rod outer diameter chamber of one cylinder communicates with the rod inner diameter chamber of another cylinder driving the reciprocal movement of the piston and rod. An equalizing vent located in each cylinder communicates between the rod outer diameter chamber and the rod inner diameter chamber to allow passage of hydraulic fluid between chambers to allow the cylinders to fully stroke and re-synchronize each cycle automatically.

12 Claims, 3 Drawing Sheets

SYNCHRONIZING CYLINDER ASSEMBLY WITH EQUAL DISPLACEMENT HYDRAULIC CYLINDER

This application claims benefit of provisional application No. 60/143,423, filed Jul. 13, 1999.

FIELD OF THE INVENTIONS

The invention relates to a synchronizing cylinder assembly incorporating equal displacement hydraulic cylinders.

BACKGROUND OF THE INVENTION

Multiple lifters using hydraulic or pneumatic cylinders are used in a variety of environments. The lifters may be used to raise and lower vehicles in service stations and repair centers as well as being used in robotics and assembly line production. In the case of an assembly line, multiple lifters may be required to vertically or laterally move a manufactured part simultaneously and at the same rate. It is often critical that the multiple lifters and the associated cylinders maintain the same extension during the manufactured process even when the load on the lifters or cylinders are unequal. Synchronizing cylinders assemblies have often used single rod cylinders.

The use of single rod cylinders has always had one drawback, being that the cylinder has a different volume displacement from the extension of the cylinder rod to the retraction of the cylinder rod. This is due to the rod diameter on one side of the piston, which makes the use of cylinders for the synchronizing of multiple units very difficult. Thus, other cylinder types have been developed.

First, there is the double rod cylinder, which equalizes the displacement with a rod on both sides of the piston. However, this creates a space issue. The design must now incorporate extra room for the cylinder rod that extends out the opposite end of the cylinder.

Second, there is the rodless cylinder. This cylinder has a carriage for mounting, as opposed to a threaded rod end, which is either mechanically or magnetically coupled to the piston. This design also has a drawback. The magnetically coupled carriage can be uncoupled from the piston while the mechanism is functioning. This uncoupling can cause machine failure or even extreme damage to the machine, while the mechanically coupled unit is prone to leakage and is not suitable for a hydraulic application.

SUMMARY OF THE INVENTION

It is the intent of the present invention to address the aforementioned concerns. According to the invention a close circuit synchronizing cylinder assembly is provided for synchronizing at least two external devices having a movable member with reciprocal movement such that the devices move at the same rate and stay level to each other within a small deviation throughout the cyclic movements of the movable members. In one aspect of the invention the synchronizing cylinder assembly includes a hydraulic cylinder for each external device wherein each hydraulic cylinder communicates with the other hydraulic cylinder in a closed circuit system. The hydraulic cylinder includes a piston slidable within the hydraulic cylinder and a piston rod projecting from a rod end of the cylinder. The interior of the cylinder is divided into 3 chambers. The rod outer diameter, rod inner diameter and cap end chambers. The rod outer diameter chamber and the rod inner diameter chamber encapsulate hydraulic fluid, while the third chamber is open to atmosphere. Multiple cylinders communicate with each other such that the hydraulic fluid in the rod outer diameter chamber of one cylinder communicates with hydraulic fluid in the rod inner diameter chamber in another cylinder.

In another aspect of the invention the synchronizing cylinder assembly includes a means for communicating fluid from the third chamber of the cylinder to a reservoir assembly. The reservoir assembly includes an inside chamber with an exhaust port open to atmosphere and means for directing hydraulic fluid that passes through seals into the third chamber, to a rod outer diameter chamber or rod inner diameter chamber of the cylinder.

In a further aspect of the invention, the cylinder has a means of bleeding air from the cylinder.

In another aspect, the cylinder includes an equalizing vent communicating between the rod outer diameter chamber and the rod inner diameter chamber to allow minimal fluid to pass therethrough to compensate for any seal leakage that would otherwise prevent full cylinder stroke.

BRIEF DESCRIPTION OF THE DRAWINGS

The description herein makes reference to the accompanying drawings wherein like reference numerals refer to like parts throughout the several views, and wherein.

DESCRIPTION OF THE INVENTION

Figure 1:
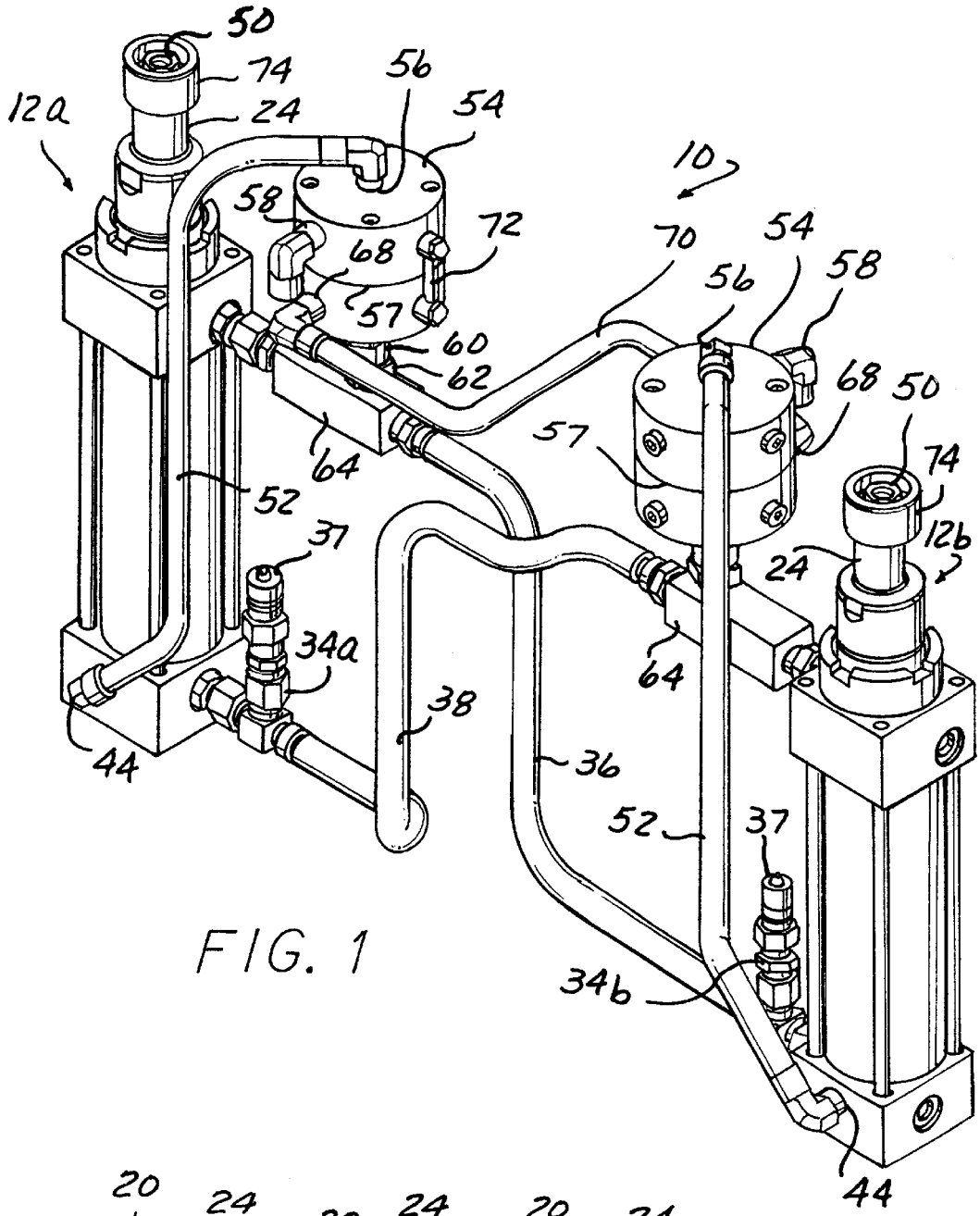
FIG. 1 is a isometric view of a synchronizing cylinder assembly according to the present invention.
Figure 3:
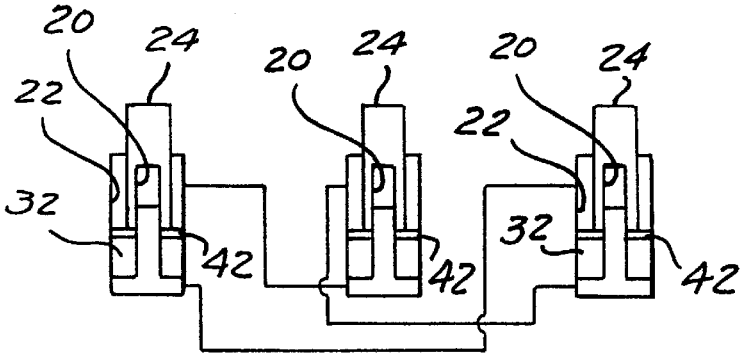
FIG. 3 is a simplified schematic diagram of a synchronizing cylinder assembly having three cylinders.
Figure 2:
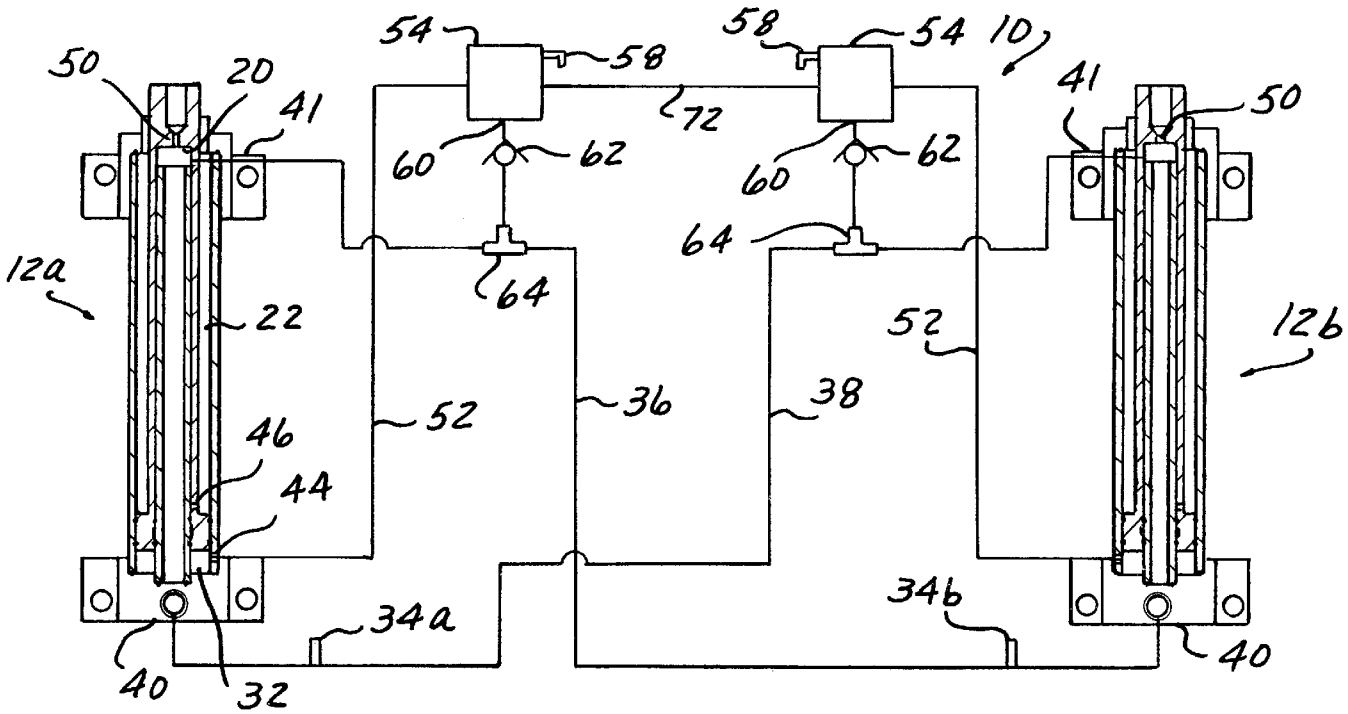
FIG. 2 is a schematic diagram of the assemble shown in FIG. 1.
Figure 4:
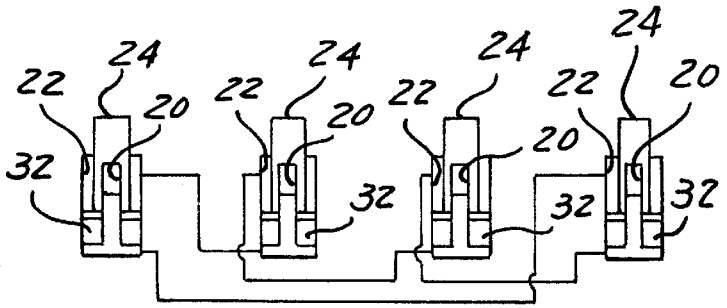
FIG. 4 is a simplified schematic diagram of the synchronizing cylinder assembly having four cylinders.
Figure 5:
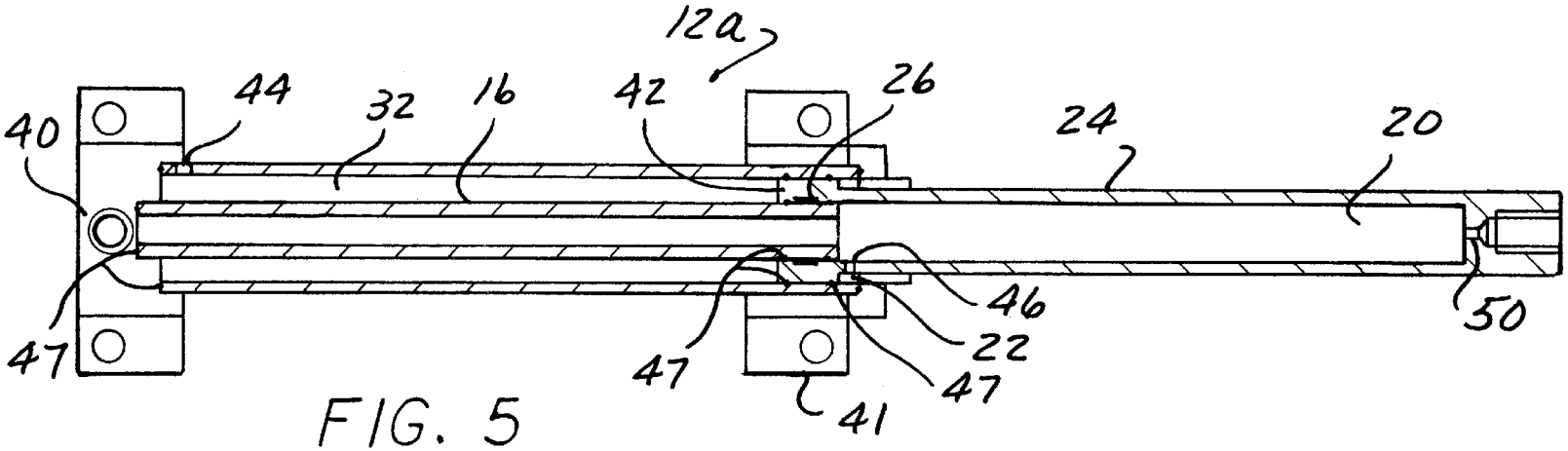
FIG. 5 is an elevational view of the cylinder used in the synchronizing cylinder assembly according to the present invention shown in the extended position.
Figure 6:
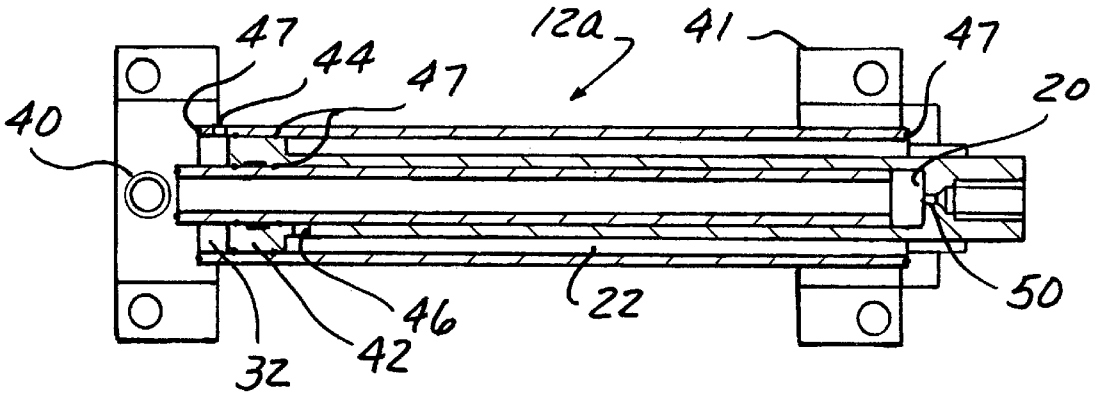
FIG. 6 is an elevational view of the cylinder in FIG. 5 shown in the retracted position.

Referring to FIGS. 1 and 2 there is illustrated a synchronizing cylinder assembly according to the present invention providing a means for synchronizing external devices having a moveable member with reciprocal movement, such that the external devices move at the same rate and the devices stay level to each other within a small deviation throughout each cyclic movement. FIGS. 1 and 2 illustrate a synchronizing cylinder assembly 10 for use to synchronize the movement of two external devices. FIGS. 3 and 4 illustrate the schematics of a synchronizing cylinder assembly for synchronizing the movement of more than two external devices.

Two synchronizing cylinders cause two external devices to move synchronously, the assembly 10 comprises a pair of single piston fluid cylinders 12*a*, 12*b* connected to each other in a closed circuit fashion by conduits. The cylinder incorporates a hollow cylinder rod 24 with an internal volume equalizing tube 16 that can be utilized in a hydraulic or hydrostatic system. The equalizing tube 16 is stationary and attached to the cylinder cap end 40. This equalizing tube 16 is properly sized to create the same volume displacement in the hollow rod, referred hereafter as the rod inner diameter chamber 20, as the volume displacement is in the piston area, referred hereafter as the rod outer diameter chamber 22, of the cylinder 12*a*, 12*b*. The equalizing tube 16 also helps guide the rod 24 through the use of a bushing 26 in the piston. The cylinder 12*a*, 12*ab* also has a third chamber 32 open to atmosphere.

The rod inner diameter chamber 20 and rod outer diameter chamber 22 are filled to equilibrium with hydraulic fluid which is introduced to the cylinders 12*a*, 12*b* through fill port assemblies 34*a*, 34*b*, which will be discussed further. The rod inner diameter chamber 20 in first cylinder 12*a* is connected to the rod outer diameter chamber 22 in second cylinder 12*b* by conduit 36. Likewise, the rod outer diameter chamber 22 in the first cylinder 12*a* is connected to the rod inner diameter chamber 20 in the second cylinder 12*b* by conduit 38.

The synchronizing cylinder assembly 10 is a passive system such that the rods 24 in cylinders 12*a*, 12*b* move relative to their connection to an external force. It is the intent that the rods 24 in cylinders 12*a*, 12*b* will move in unison such that both rods 24 will extend and both rods 24 will retract at the same time. Therefore the extension and retraction of a single cylinder will now be discussed.

Hydraulic fluid will enter the cap end 40 of cylinder 12*a* and flow through the equalizing tube 16 and enter the rod inner diameter chamber 20. This will create the push, or extend, action of the cylinder. While at the same time, the hydraulic fluid in the rod outer diameter chamber 22 will exit the head end 41. An air vent 44, in the cap end 40, will allow air to enter the third chamber 32. In addition, there is a hydraulic fluid equalizing vent 46 through the cylinder rod 24 providing communication between the rod inner diameter chamber 20 and the rod outer diameter chamber 22 to create a bypass at the end of the cylinder stroke in a synchronizing application. The fluid equalizing vent 46 compensates for hydraulic fluid blowing by the piston seals 47 and 26 at the end of the stroke and causing one or more of the synchronizing cylinders 12*a*, 12*b* to not fully seat at the end of the stroke. The vent 46 is a minimal size in comparison to the cylinder diameter. The vent 46 will allow a minimal amount of hydraulic fluid to pass therethrough so that at the end of each stroke cycle, the synchronizing cylinders 12*a*, 12*b* can fully stroke and re-synchronize each cycle automatically.

For cylinder retraction, hydraulic fluid enters the rod outer diameter chamber 22 of the cylinder 12*a*, pushing the piston 42 toward the cap 40 and causing air to be removed from the third chamber 32 and escape out the air vent 44 in the cap end 40. This will cause the piston 42 and rod 24 to retract and the hydraulic fluid in the rod inner diameter chamber 20 to exit through the equalizing tube 16 and out the cap end 40. Again, any hydraulic fluid that blows by the piston seals 47 and 26 at the end of this stroke will be vented between the rod inner diameter chamber 20 and rod outer diameter chamber 22 by the fluid equalizing vent 46 so that the cylinders 12*a*, 12*b* fully stroke.

Looking again at FIGS. 1 and 2, the cylinders 12*a* and 12*b* are filled with hydraulic fluid through fill port assemblies 34*a* and 34*b*. A bleed 50 is provided through the end of the hollow rod 24 and into the rod inner diameter chamber 20 so that when the cylinders 12*a* and 12*b* are filled to their maximum, hydraulic fluid will escape through the bleed port 50 to indicate when to discontinue hydraulic fluid filling. The fill port assemblies 34*a* and 34*b* may include a quick connect end 37 for connection to an appropriate conduit connected to an external reservoir storing hydraulic fluid.

The synchronizing cylinder assembly 10 further includes a conduit 52 from air vent 44 to a reservoir 54. The inlet to reservoir 54 is shown at 56. The inlet 56 is positioned at the uppermost wall of reservoir 54. A vent 58 is positioned along an upper sidewall of the reservoir 54. Vent 58 is open to atmosphere to allow the easy flow of air in and out of the reservoir and ultimately to the third chamber 32 via conduit 52. An exit port 60 having a one way check valve 62 incorporated therein is positioned at a lower wall of reservoir 54. The check valve 62 is connected to one of the conduits 36 and 38 through a T-connection 64. The lower portion of each reservoir 54 also includes an inlet/outlet port 68 which is connected to a conduit 70 leading to the lower portion of another reservoir 54. Conduit 70 provides a level tube between reservoirs 54 so that the volume of hydraulic fluid remains the same in each cylinder despite any more leakage in one cylinder in comparison to the other cylinder. In addition, the reservoir may include a sight gauge 72 to visually ascertain the amount of hydraulic fluid being collected by the reservoirs 54.

The reservoir 54 collects any hydraulic fluid that may have seeped past the seats between one of the hydraulic fluid chambers and the pneumatic third chamber 32 such that the hydraulic fluid enters or is located in the third chamber 32. When the air is vented out of the third chamber 32, the hydraulic fluid is also vented through air vent 44 into conduit 52 and then into the reservoir 54. The hydraulic fluid falls to the lower surface of the reservoir 54 via gravity. The lighter air is vented out through vent passage 58.

The assembly instructions for the synchronizing cylinder assembly 10 are as follows: Mount fill port assembly 34*a* to a port on the cap end 40 of the cylinder 12*a*, 12*b*. Mount the reservoir assembly 54 to a port on the head end of cylinder 12*a*, 12*b*. Attach elbow to cylinder recirculation port 44. Attach tubing 52 to recirculation port elbow. (Note: Do not connect reservoir elbow until filling is completed). The cross-over conduits 36, 38 are then attached between cylinders. Attach level tube 70 between reservoirs 54 and then attach exhaust vent elbow 58 to any upper port on reservoir 54. Finally, turn elbow such that it points towards the ground.

After the aforementioned assembly is completed, the synchronizing cylinder assembly 10 may be filled with hydraulic fluid. Initially, level the reservoir 54 to within ¼", and then fully extend both cylinder rods 24. Attach the fill pump from a remote fluid reservoir (not shown) to fill port assembly 34*a*, 34*b*. Remove the plug from bleed port 50. Fill the cylinder 12*a* or 12*b* until hydraulic fluid comes out bleed port 50 and immediately remove disconnect at fill port 34*a*, 34*b*. Then the plug in bleed port 50 can be replaced. Add hydraulic fluid to reservoir 56 until filled to mid-lines 57. This ensures that air does not get introduced into the cylinders through outlet 60 in the reservoir 54. Attach elbow and tube from breather to reservoir fill port 56. Repeat the steps for each cylinder in common system. Cycle cylinders 12*a*, 12*b* several times to bring the synchronizing cylinder assembly 10 to equalibrium.

In operation the rods 24 will be connected mechanically to a lifter or other reciprocal moving device (not shown). The reciprocal moving device will be connected to the rod end at the location generally indicated as 74 in FIG. 1. External forces will move the reciprocal devices and the attached cylinder rods 24. The reciprocal devices will be synchronized by the synchronizing cylinder assembly 10 because the fluid equalizing vent 46 will adjust for any leakage of the hydraulic fluid past the piston seals at the end of the stroke to equalize the system such that the synchronizing cylinder rods 24 can fully stroke and resynchronize for each cycle automatically. Any hydraulic fluid which may get past the seals and into the pneumatic third chamber will be directed to the reservoir 54. Such a leakage as described, as well as other conditions can cause a pressure drop in the system and especially at the T-connectors 64. Since the reservoir is open to atmosphere pressure at port 58, a pressure drop in the system at the T-connector 64 will result in a pressure differential which will open spring biased check valve 62 and allow enough hydraulic fluid into the system to equalize the pressure and eliminate the pressure differential between the system and the reservoir. The compensation of pressure drop has the effect of pressurizing the system. The pressurized system increases the degree of synchronization by pressure preloading of the hydraulic lines. If one cylinder has blow by leakage more than another cylinder in the system, the hydraulic fluid in that associated reservoir may be depleted. The level conduit 70 eliminates this condition by maintaining the level of hydraulic fluid in each reservoir to remain essentially equal. A visual sight gauge 72 is provided for the operator to manually observe the condition of each reservoir.

Although the synchronizing cylinder assembly has been discussed having two equal displacement hydraulic cylinders, the synchronizing cylinder assembly 10 can be modified for use with any number of equal displacement hydraulic cylinders. Simple schematics of synchronized cylinder assemblies having three and four hydraulic cylinders are shown in FIGS. 3 and 4 respectively. It is to be known that the system is not limited to two, three or four cylinders, but may entail as many cylinders as is required in the system for a particular operation.

What is claimed is:

1. A synchronizing cylinder assembly for synchronizing at least two external devices having a movable member with reciprocal movement at the same rate such that the devices stay level to each other within a small deviation the assembly comprising:

a hydraulic cylinder for each external device, wherein each hydraulic cylinder communicates with the other hydraulic cylinder in a closed circuit system, said hydraulic cylinder comprises a piston slidable within the hydraulic cylinder and a piston rod projecting from the rod end of the cylinder, said piston rod dividing the interior of the cylinder into a rod outer diameter chamber, a rod inner diameter chamber and a third chamber, wherein the rod outer diameter chamber and the rod inner diameter chamber houses hydraulic fluid and said third chamber is open to atmosphere for receiving atmospheric air, wherein each direction of the reciprocal movement, the hydraulic fluid in the rod outer diameter chamber of one of the hydraulic cylinders flows to the rod inner diameter chamber of the other hydraulic cylinder while the hydraulic fluid in the outer diameter chamber of the other hydraulic cylinder flows to the rod inner diameter chamber of the one hydraulic cylinder.

2. The synchronizing cylinder assembly of claim 1, wherein the piston has equal areas on its rod outer diameter and its rod inner diameter sides.

3. The synchronizing cylinder assembly of claim 1, further comprising a first conduit communicating between the rod outer diameter chamber of one of the cylinders and the rod inner diameter chamber of the other cylinder, a second conduit communicating between the rod inner diameter chamber of the one of the cylinders and the rod outer diameter chamber of the other cylinder, and a third conduit communicating between the third chamber of one of the cylinders and a reservoir assembly.

4. The synchronizing cylinder assembly of claim 3, wherein the rod has a selectively open and closed bleed port communicating with the rod inner diameter chamber of the cylinder.

5. The synchronizing cylinder assembly of claim 3, further comprising a first fill port assembly communicating with the first conduit and a second fill port assembly communicating with the second conduit.

6. The synchronizing cylinder assembly of claim 1, wherein the reservoir assembly has an inlet port open to the third conduit and an exhaust port open to atmosphere, and said reservoir assembly has means for allowing atmospheric air to flow to the third chamber and has means for receiving hydraulic fluid from the third chamber.

7. The synchronizing cylinder assembly of claim 1, wherein said piston rod of each cylinder has an equalizing vent therethrough for providing fluid communication between the rod outer diameter chamber and the rod inner diameter chamber of the cylinder.

8. The synchronizing cylinder assembly of claim 7, wherein the equalizing vent has a minimal diameter in comparison to the diameter of the cylinder.

9. The synchronizing cylinder assembly of claim 1, wherein each cylinder has a first and second end and a stationary tube disposed in the cylinder and attached to one of the first and second ends, wherein said stationary tube is sized to create the same volume displacement in the rod inner diameter chamber as the volume displacement in the rod outer diameter chamber during the reciprocal movement.

10. A synchronizing cylinder assembly for synchronizing at least two external devices having a movable member with reciprocal movement at the same rate such that the devices stay level to each other within a small deviation the assembly comprising:

a hydraulic cylinder for each external device, wherein each hydraulic cylinder communicates with the other hydraulic cylinder in a closed circuit system, wherein the hydraulic cylinder comprises a piston slidable within the hydraulic cylinder and a piston rod projecting from a rod end of the cylinder, said piston dividing the interior of the cylinder into a rod outer diameter chamber, a rod inner diameter chamber and a third chamber, said assembly further comprising a first conduit communicating between the rod outer diameter chamber of one cylinder and the rod inner diameter chamber of another cylinder, a second conduit communicating between the rod inner diameter chamber of the one cylinder and the rod outer diameter chamber of the other cylinder, and a third conduit communicating between the third chamber of the cylinder and a reservoir assembly, wherein the reservoir assembly has an inlet port open to the third conduit and an exhaust port open to the atmosphere, and wherein the reservoir assembly has an inside chamber portion located downstream from the open exhaust port and said chamber portion communicates with one of the first and second conduits via a directional check valve.

11. A synchronizing cylinder assembly for synchronizing at least two external devices having a movable member with reciprocal movement at the same rate such that the devices stay level to each other within a small deviation the assembly comprising:

a hydraulic cylinder for each external device, wherein each hydraulic cylinder communicates with the other hydraulic cylinder in a closed circuit system, wherein the hydraulic cylinder comprises a piston slidable within the hydraulic cylinder and a piston rod projecting from a rod end of the cylinder, said piston dividing the interior of the cylinder into a rod outer diameter chamber, a rod inner diameter chamber and a third chamber, said assembly further comprising a first conduit communicating between the rod outer diameter chamber of one cylinder and the rod inner diameter chamber of another cylinder, a second conduit communicating between the rod inner diameter chamber of the one cylinder and the rod outer diameter chamber of the other cylinder, and a third conduit communicating between the third chamber of the cylinder and a reservoir assembly wherein said cylinder assembly has means for leveling the hydraulic fluid between reservoir assemblies.

12. A synchronizing cylinder assembly for synchronizing at least two external devices having movable member with reciprocal movement at the same rate such that the devices stay level to each other within a small deviation the assembly comprising:

a hydraulic cylinder for each external device, wherein each hydraulic cylinder communicates with the other hydraulic cylinder in a closed circuit system, wherein the hydraulic cylinder comprises a piston slidable within the hydraulic cylinder and a piston rod projecting from a rod end of the cylinder, said piston dividing the interior of the cylinder into a rod outer diameter chamber, a rod inner diameter chamber and a third chamber and further comprising means for increasing the degree of synchronization of the assembly through hydraulic pressure preloading.

* * * * *